US007546078B2

(12) United States Patent
Okuda et al.

(10) Patent No.: US 7,546,078 B2
(45) Date of Patent: Jun. 9, 2009

(54) IMAGE HEATING APPARATUS AND IMAGE FORMING APPARATUS WITH DISPLACING MEMBERS FOR DISPLACING OTHER MEMBERS OF THE APPARATUSES

(75) Inventors: Kazuhisa Okuda, Tokyo (JP); Masahiko Yokota, Abiko (JP); Michiaki Endo, Abiko (JP); Shinsuke Ubayashi, Kashiwa (JP); Takatoshi Chiba, Kashiwa (JP); Hiromasa Katayama, Toride (JP); Hiromitsu Uchida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 11/530,171

(22) Filed: Sep. 8, 2006

(65) Prior Publication Data

US 2007/0059064 A1 Mar. 15, 2007

(30) Foreign Application Priority Data

Sep. 13, 2005 (JP) ..... 2005-266116

(51) Int. Cl.
*G03G 15/20* (2006.01)

(52) U.S. Cl. ..... 399/329; 399/325; 399/326

(58) Field of Classification Search ..... 399/162, 399/164, 324–326, 320, 116, 349, 329; 219/216, 219/469–471
See application file for complete search history.

(56) References Cited

U.S. PATENT DOCUMENTS

| | | | | |
|---|---|---|---|---|
| 5,099,288 | A * | 3/1992 | Britto et al. | 399/320 |
| 5,243,384 | A * | 9/1993 | Everdyke et al. | 399/116 |
| 5,655,205 | A * | 8/1997 | Ziegelmuller et al. | 399/162 |
| 6,055,396 | A * | 4/2000 | Pang | 399/164 |
| 6,973,278 | B2 * | 12/2005 | Miller et al. | 399/116 |
| 7,194,233 | B2 * | 3/2007 | Wu et al. | 399/329 |
| 7,289,758 | B2 * | 10/2007 | Kim et al. | 399/329 |
| 7,308,219 | B2 * | 12/2007 | Shishido | 399/329 |
| 7,356,284 | B2 * | 4/2008 | Yamada et al. | 399/162 |
| 7,418,229 | B2 * | 8/2008 | Aruga et al. | 399/329 |
| 2005/0053395 | A1 * | 3/2005 | Fiore et al. | 399/116 |
| 2007/0059061 | A1 | 3/2007 | Katayama et al. | 399/329 |
| 2007/0059062 | A1 | 3/2007 | Endo et al. | 399/329 |

FOREIGN PATENT DOCUMENTS

| | | | |
|---|---|---|---|
| JP | 02126281 | A * | 5/1990 |
| JP | 2002-148970 | | 5/2002 |

* cited by examiner

*Primary Examiner*—Susan S Lee
(74) *Attorney, Agent, or Firm*—Fitzpatrick, Cella, Harper & Scinto

(57) ABSTRACT

An image heating apparatus includes an endless belt for heating an image on a recording material at a nip; a pressing pad for pressing the belt at the nip; a supporting member for supporting the belt at an inner surface thereof, the supporting member being displaceable to move the belt in a widthwise direction of the belt; a lubricant application member for applying lubricant onto the inner surface of the belt; and displacing means for displacing the lubricant application member in accordance with a displacement of the supporting member.

8 Claims, 15 Drawing Sheets

IMAGE HEATING APPARATUS AND IMAGE FORMING APPARATUS WITH DISPLACING MEMBERS FOR DISPLACING OTHER MEMBERS OF THE APPARATUSES

FIELD OF THE INVENTION AND RELATED ART

The present invention relates to an image heating apparatus for heating an image on a recording material. Such an image heating apparatus may be a fixing device for fixing an unfixed image on a recording material, or a glossiness improving apparatus for improving a glossiness of the image by re-heating the image already fixed on the recording material.

The present invention relates also to an image forming apparatus having an endless belt. Such an image forming apparatus may be a copying machine, a printer, a facsimile machine, or a complex machine having combined functions of them.

It is conventional that image forming apparatus of an electrophotographic type fixes a toner image on a sheet by heat and pressure. An example of such a fixing device is disclosed in Japanese Laid-open Patent Application 2002-148970 wherein the uses made with a pressing belt to increase the size of a fixing nip (belt fixing type device).

In such a belt fixing device, in order to reduce the sliding resistance between the pressing belt and the pressing pad, there is provided an oil application member for applying oil on the inner surface of the pressing belt.

In addition, in such a belt fixing device, the position of the pressing belt in the widthwise direction is controlled by inclining a steering roller on which the pressing belt is trained. In the fixing device, the oil application member is disposed at such a position that the state of stretching of the pressing belt does not change with the displacement of the steering roller.

The inventors have investigated about the arrangement of the oil application member in the neighborhood of the steering roller, and have found that contact state between the oil application member and a pressing belt is changed by the displacement of the steering roller. In the worst case, the pressing belt and the oil application member are separated from each other.

If this occurs, the oil application member is unable to apply the oil properly on the inner surface of the pressing belt with the result of partly increased sliding resistance between the pressing belt and the pressing pad.

In the case that cleaning member is provided to clean the inner surface of the pressing belt, the above-described variation of the contact state which may result in defective cleaning action in some cases.

From the foregoing, there is a liability that the belt travels unstably because of the variation in the contact state between the belt and the member acting thereon.

SUMMARY OF THE INVENTION

Accordingly, it is a principal object of the present invention to provide an image heating apparatus and an image forming apparatus in which the belt travelling is stabilized.

It is another object of the present invention to provide an image heating apparatus and an image forming apparatus in which lubricant can be properly applied to the inner surface of the belt, thus stabilizing the travelling of the belt.

It is a further object of the present invention to provide an image heating apparatus and an image forming apparatus in which the inner surface of the belt is properly cleaned so that travelling of the belt is stabilized.

According to an aspect of the present invention, there is provided an image heating apparatus, comprising an endless belt for heating an image on a recording material at a nip; a pressing pad for pressing said belt at said nip; a supporting member for supporting said belt at an inner surface thereof, said supporting member being displaceable to move said belt in a widthwise direction of said belt; a lubricant application member for applying lubricant onto the inner surface of the belt; and displacing means for displacing said lubricant application member in accordance with a displacement of said supporting member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred Embodiments of the image heating apparatus and the image forming apparatus according to the present invention will be described.

Embodiment 1

(Image Forming Apparatus)

Figure 9:
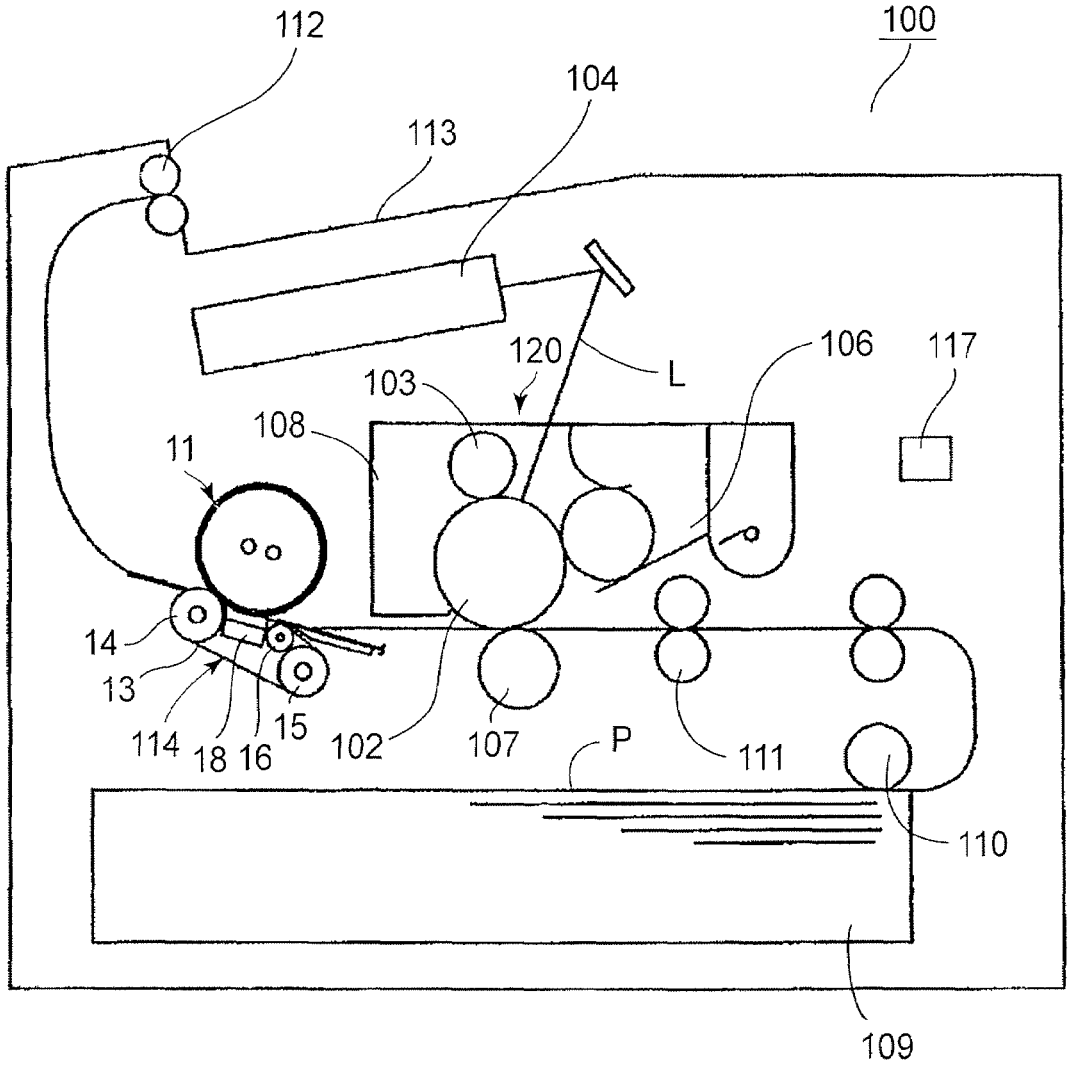
FIG. 9 schematically illustrates an image forming apparatus provided with the fixing device and the belt feeding device according to the first embodiment of the present invention.

Referring first to FIG. 9, there is shown a schematic sectional view of a printer which is an image forming apparatus using an electrophotographic type process, according to an embodiment of the present invention. Here, the image forming apparatus may be a printer, a copying machine, facsimile and a complex machine thereof, or the like, and therefore, the image forming apparatus of the present invention is not limited to the printer as in this embodiment. The values stated in the description of this embodiment are examples, and are not restrictive in the present invention.

The image forming apparatus in the form of a printer 100 comprises an image forming station 120 for forming a toner image on a transfer material in the form of as sheet, a fixing device 114 for fixing the toner image on the sheet by heat and pressure, and a controller 117 for controlling the entirety of the printer. The image heating apparatus 114 provided in this printer 100 is that of the first embodiment, but may be an image heating apparatus 115 of a second embodiment of the present invention which will be described hereinafter.

The image forming station 120 comprises a charger 103 adjacent to the photosensitive drum 102 (image bearing member). The surface of the photosensitive drum 102 is uniformly charged by the charger 103. The photosensitive drum 102 is exposed to light L which is emitted from an exposure device 104 and modulated in accordance with an image so that an electrostatic latent image is formed on the surface of the photosensitive drum 102. The electrostatic latent image is visualized into a toner image by development with the developing device 106.

On the other hand, the feeding cassette 109 provided at a lower portion of the apparatus contains sheets P. The sheet P is fed to a pair of registration rollers from the feeding cassette 109 by the feeding roller 110. The pair of the registration roller functions to correct inclination of the sheet fed thereto and to feed the sheet into between the photosensitive drum 102 and a transfer roller 107 (transfer portion).

The toner image on the photosensitive drum 102 is electrostatically transferred onto the sheet by the transfer roller 107. The sheet now having the toner image transferred thereonto is conveyed to the fixing device 114 (image heating apparatus). The toner remaining on photosensitive drum 102 is removed by the cleaning device 108.

The sheet is heated and pressed by the fixing device 114 so that a toner image is fixed. Thereafter, the sheet P on which the toner image has been fixed is fed by a pair of discharging rollers 112 to a discharging tray 113 which is disposed at an upper portion of the apparatus, and the sheet is discharged there.

The fixing device 114 or 115 of the printer 100 for fixing of the toner image on the sheet has structures which will be described in detail hereinafter, and therefore, the printer 100 is capable of producing a high-quality toner image on the sheet.

(Structure of Fixing Device)

Referring to FIG. 1 through FIG. 8, the fixing device (image heating apparatus) of this embodiment will be described. The fixing device 114 comprises a heating roller 11 and a belt feeding device 121.

The belt feeding device 121 comprises an endless belt 13 which will be called simply as "belt", belt training means in the form of a pressing roller 14, and a steering roller (supporting member) 15. The belt feeding device 121 comprises a lubricant application member in the form of an oil application roller 16, displacement means in the form of arm members (holding or supporting members) 17*a*, 17*b* (FIGS. 1 and 7), a pressing pad 18, urging springs 19*a*, 19*b* and a correction mechanism 116 and so on.

Figure 2:
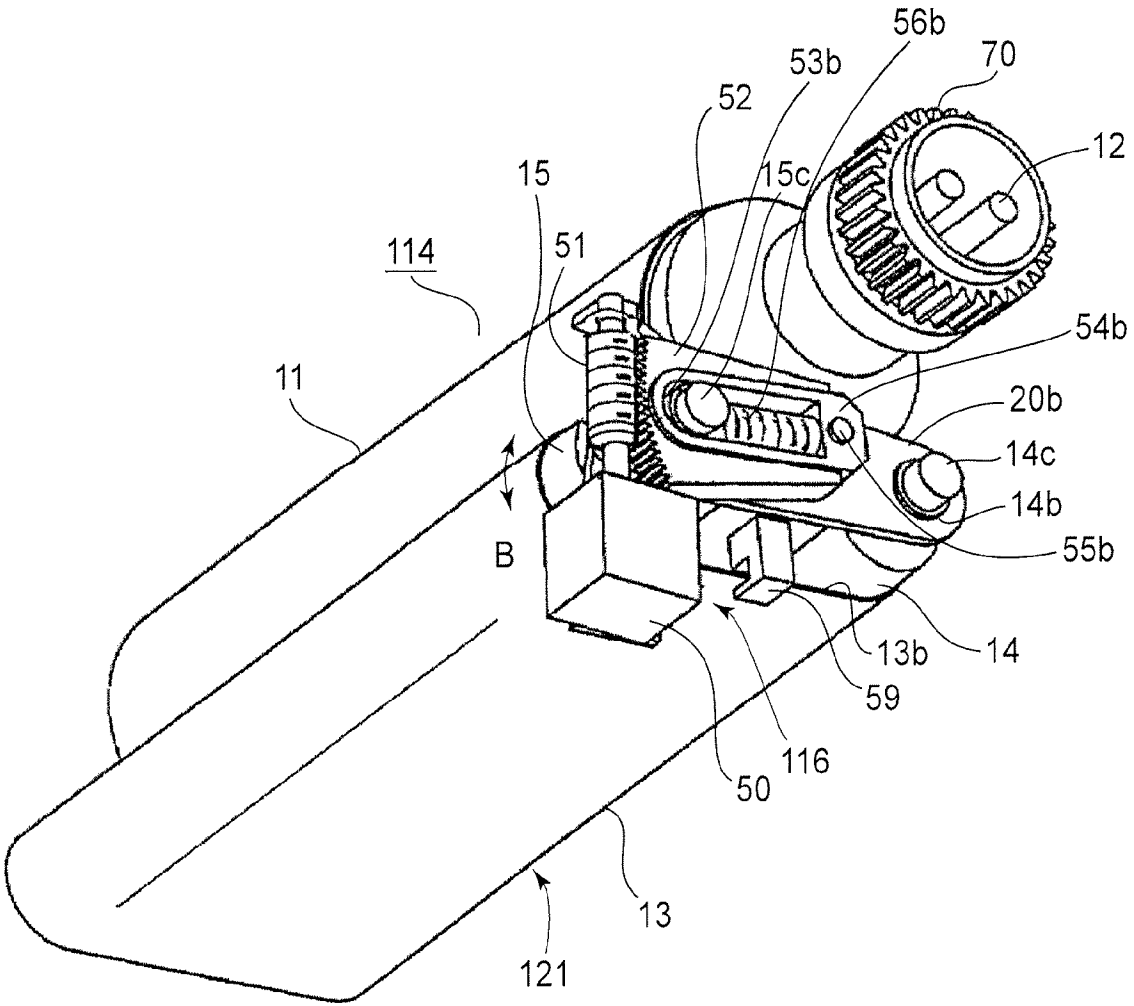
FIG. 2 is a perspective view of an outer appearance of a belt feeding device employed in the fixing device of FIG. 1.
Figure 3:
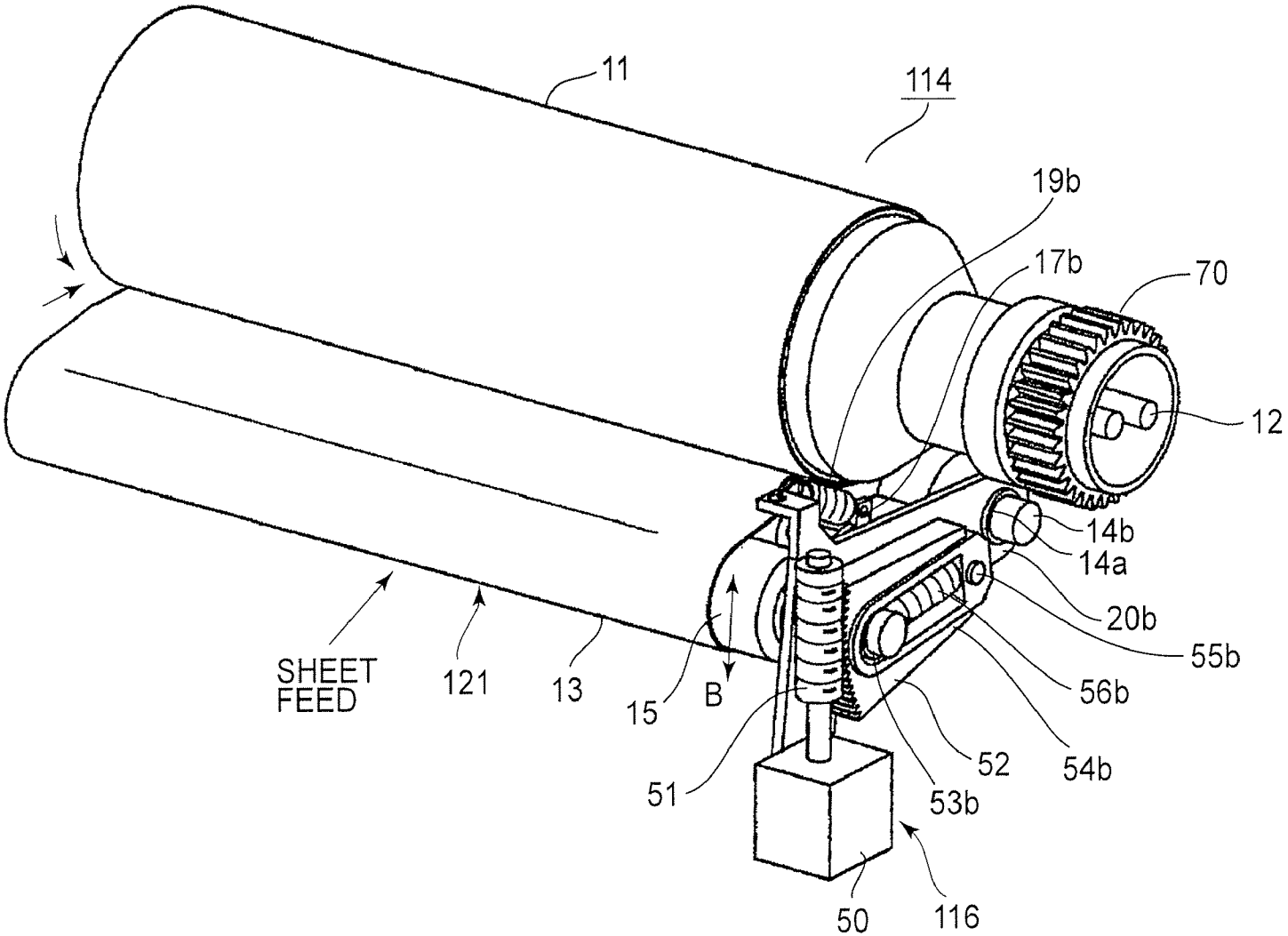
FIG. 3 is a perspective view of an outer appearance of a belt feeding device employed in the fixing device of FIG. 1.
Figure 4:
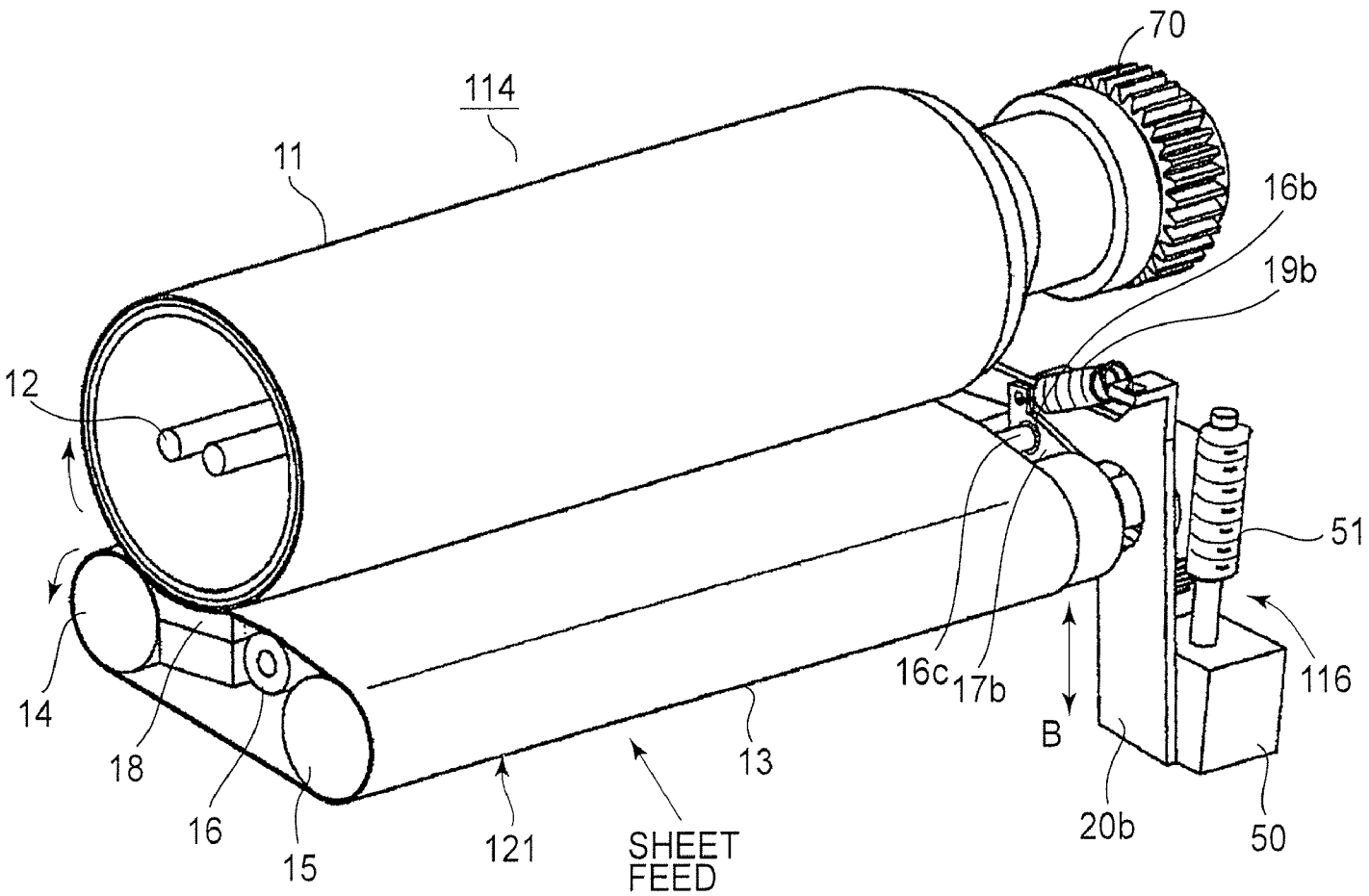
FIG. 4 is a perspective view of an outer appearance of a belt feeding device employed in the fixing device of FIG. 1.

The heating roller 11 (heating rotatable member) has a halogen heater 12 therein. The heating roller 11 applies the heat generated by the halogen heater 12 to the toner image T and to nip the sheet P strongly with the belt 13 thus feeding the sheet by rotation thereof. As shown in FIG. 2 through FIG. 4, the heating roller 11 is provided at its end with a drive input gear 70 for receiving a rotating force from a driving motor (driving means) provided in the main assembly side of the printer 100.

The heating roller 11 comprises, for example, a metal core 11*a* in the form of aluminum cylinder having an outer diameter of 56 mm and an inner diameter of 50 mm. The metal property core 11*a* contains the halogen heater 12. The surface of the metal core 11*a* is coated with an elastic layer of silicone rubber having a thickness of 2 mm and a hardness (Asker C) of 45°, and the surface layer of the elastic layer is coated with a heat resistive parting layer 11*c* of PFA or PTFE material.

The belt 13 is trained and stretched around the pressing roller 14 and the steering roller 15 with such a predetermined tension (196N, for example) as to permit circulation travelling.

Figure 8:
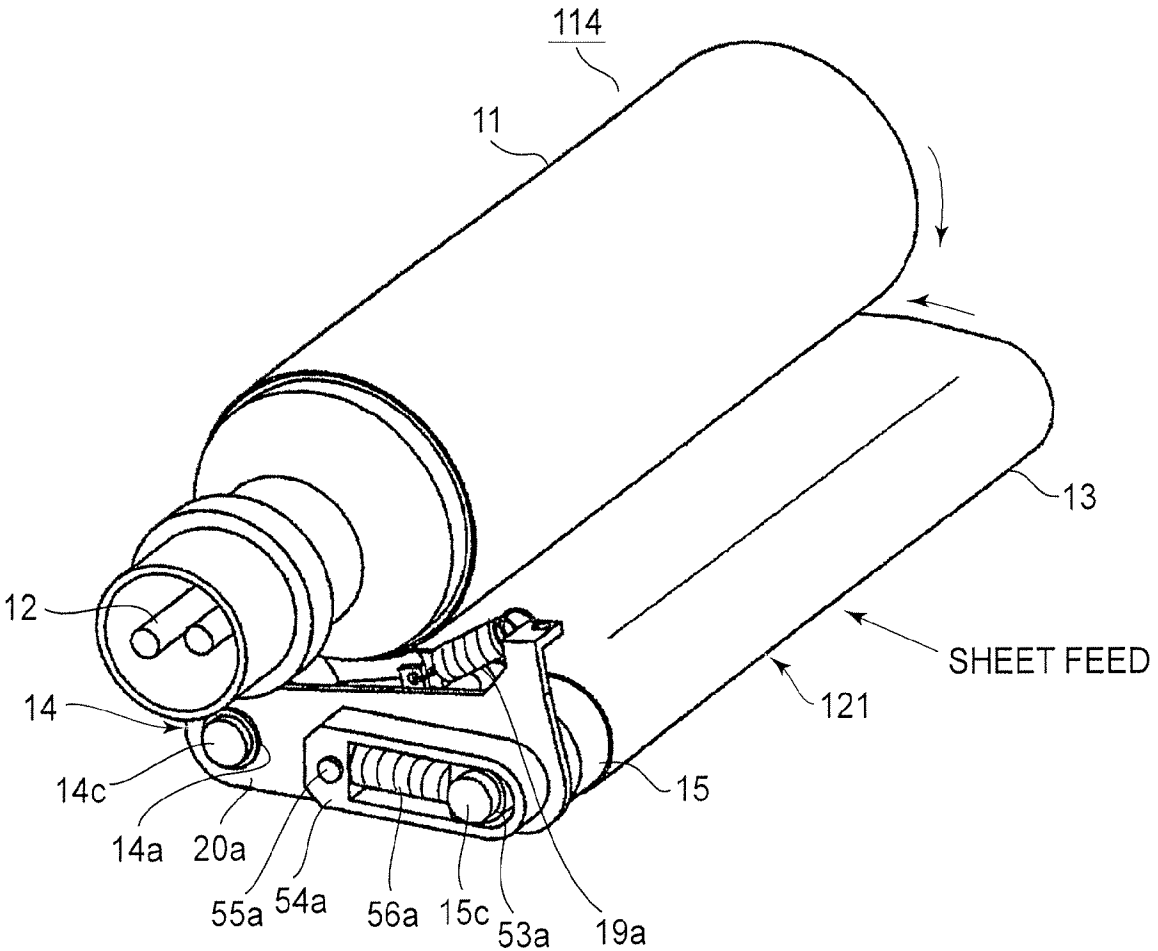
FIG. 8 is a partly omitted perspective view of an outer appearance of a belt feeding device employed in the fixing device of FIG. 1.

The pressing roller 14 is a roller of a solid stainless steel having a diameter of 20 mm, for example. The pressing roller 14 is disposed at the exit side of the nip region formed by the heating roller 11 and the belt 13 and is pressed against the heating roller 11 with a predetermined pressing force so as to deform the elastic layer elastically. As shown in FIGS. 2 and 8, a shaft 14*c* of the pressing roller 14 is supported on the side plates 20*a*, 20*b* by bearings 14*a*, 14*b*.

The steering roller 15 functioning as a supporting member (displacement member) is a hollow roller of stainless steel having an outer diameter of 20 mm and an inner diameter of 18 mm. The steering roller 15 is controlled by correction mechanism 116 (belt moving means) to displace or incline when the belt is circulated with lateral deviation in the direction of the axes of the rollers 14, 15 or when the belt is making snaking movement. By the control, the travelling position, in the widthwise direction, of the belt is corrected. The steering roller 15 is effective to apply tension to the belt 13.

The belt 13 may be made of any material if the heat resistivity is sufficient. The belt 13 is an endless belt comprising polyimide film having a thickness of 75 &m&m, a width of 380 mm and a circumferential length of 200 mm, and a silicone rubber coating having a thickness of 300 &m&m thereon.

A pressing pad 18 made of silicone rubber is provided inside the belt 13 at a position corresponding to the entrance side (upstream side of the pressing roller 14) of the nip region formed by the heating roller 11 and the belt 13. The pressing pad 18 is urged toward the heating roller 11 with a predetermined pressure, 400N, for example, and it cooperates with the pressing roller 14 to form the nip.

Between the steering roller 15 and the pressing pad 18, there is provided an oil application roller 16 (lubricant application member) to an inner surface 13*a* of the belt 13. The oil application roller 16 is interrelated with the steering roller 15 by the arm members 17*a*, 17*b* (holding member) (FIGS. 1 and 4) so as to be displaceable with the steering roller 15. Namely, the oil application roller is displaced in accordance with the movement of the steering roller by the arm members 17*a*, 17*b*.

The arm members 17*a*, 17*b* are supported by the bearings 15*a*, 15*b* on the steering roller 15. At the end of rotation of the arm members 17*a*, 17*b*, there are provided bearings 16*a*, 16*b*

(FIGS. 4 and 7) for the oil application roller 16. The opposite ends of the shaft 16*c* (FIGS. 4, 7) of the oil application roller 16 are supported by the bearings 16*a*, 16*b*. Therefore, the opposite ends of the oil application roller 16 are rotatably supported on the arm members 17*a*, 17*b* by the bearings 16*a*, 16*b*.

Figure 5:
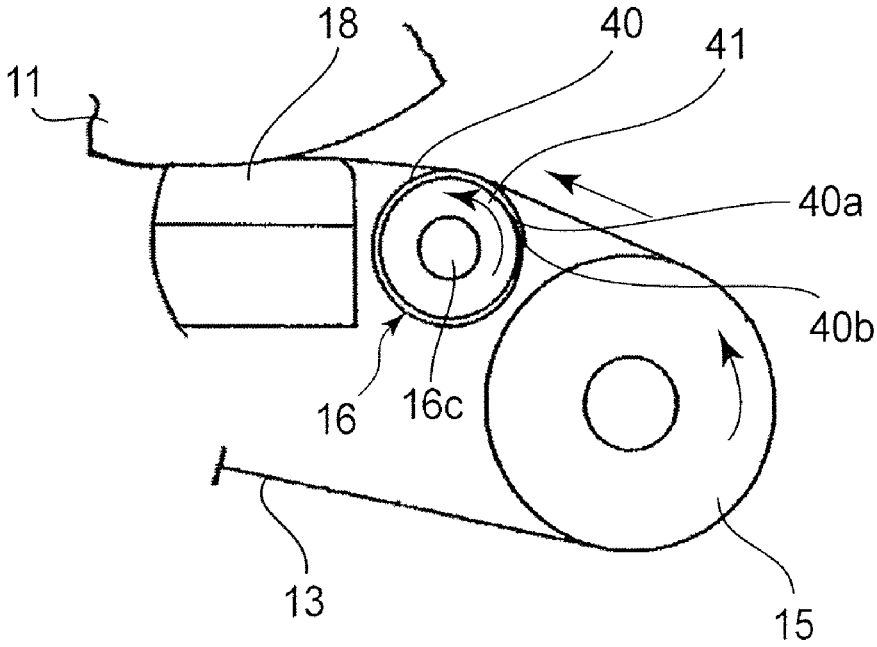
FIG. 5 illustrates the structures around an oil application roller in the belt feeding device employed in the fixing device of FIG. 1.
Figure 6:
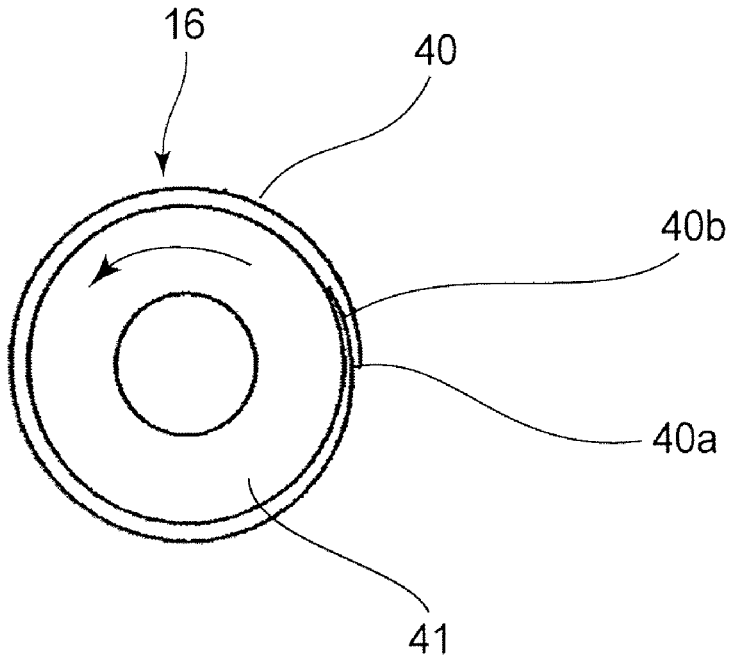
FIG. 6 is a sectional view of the oil application roller in the belt feeding device employed in the fixing device of FIG. 1.
Figure 7:
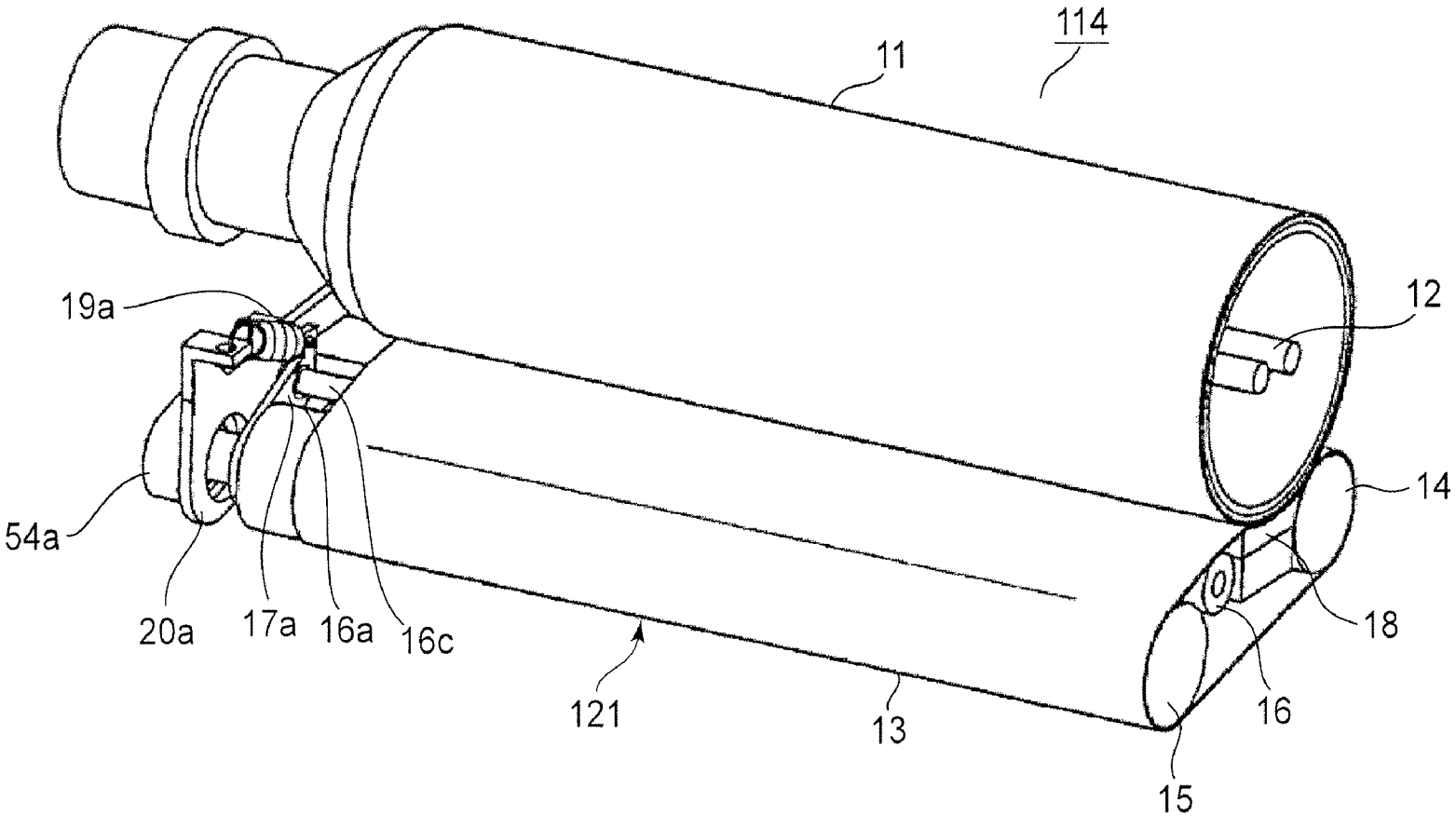
FIG. 7 is a partly omitted perspective view of an outer appearance of a belt feeding device employed in the fixing device of FIG. 1.

As shown in FIGS. 4, 5, the inside of the oil application roller 16 is made of heat resistive aramid felt 41 impregnated with heat resistive silicon oil having a viscosity of approx. 1000 CS. The surface layer of the heat resistive aramid felt 41 is coated with an oil application control film 40 of porous PTFE layer. A rear end 40*a* (with respect to the rotational direction) of the oil application control film 40 is folded back, and pasted and fixed on the front side of the front end 40*b* with heat resistive fluorine adhesive material, so that end portions thereof is not turning-up during sliding movement relative to the belt 13. With such a structure, the oil application roller 16 stably supplies the silicon oil to the inner surface of the belt 13.

Arm urging springs 19*a*, 19*b* (FIGS. 1 and 4) are stretched between arm members 17*a*, 17*b* and side plates 20*a*, 20*b* (FIGS. 3 and 7), respectively. Urging springs 19*a*, 19*b* function to contact the oil application roller 16 closely to the belt 13 to assure the application of the silicon oil by the oil application roller 16 to the inner surface 13*a* of the belt 13 and also function to apply tension to the belt 13.

As shown in FIGS. 2 and 3, a shaft 55*b* is projected outwardly from the side plate 20*b*, and on the shaft 55*b* a steering roller supporting arm 54*a* is rotatably supported to support the steering roller 15. The outer periphery of the steering roller supporting arm 54*b* is provided with a sector-shape gear 52. The sector gear 52 is in meshing engagement with a warm 51 which is rotatable by a stepping motor 50. Therefore, the steering roller supporting arm 54*b* is rotatable about the shaft 55*b* by the stepping motor 50.

As shown in FIG. 8, a shaft 55*a* is projected from a side plate 20*b*, and a steering roller supporting arm 54*a* for supporting the steering roller 15 is fixed on the shaft 55*a* at the outside of the side plate 20*a*.

In FIG. 2, the steering roller supporting arm 54*b*, the sector gear 52, the warm 51, the stepping motor 50 and so on constitute a correction mechanism 116 (swing means) for correcting the travelling position with respect to the widthwise direction of the belt by inclining the steering roller 15 relative to the pressing roller 14.

As shown in FIGS. 2 and 8, the steering roller supporting arms 54*a*, 54*b* support the steering roller bearings 53*a*, 53*b*. The steering roller bearings 53*a*, 53*b* rotatably support the shaft 15*c* of the steering roller 15 so that steering roller supporting arms 54*a*, 54*b* are supported slidably in the direction of the belt tension. In addition, the steering roller supporting arms 54*a*, 54*b* also support the tension springs 56*a*, 56*b* for urging the steering roller bearings 53*a*, 53*b* in the belt tension direction.

As shown in FIG. 2, a photo-sensor 59 (detecting means) for detecting a lateral edge 13*b* of the belt 13 is provided adjacent to the lateral edge of the belt 13.

(Various Operations of Fixing Device)

To the fixing device 114, a sheet P on which the toner image T has been transferred is fed. The belt 13 is nipped between the heating roller 11 and the pad 18 and between the heating roller 11 and the pressing roller 14. The sheet is fed by the nip formed between the belt 13 and the heating roller 11 which is driven. The heating roller 11 is heated by the halogen heater 12. Therefore, the fixing device 114 applies heat and pressure to the sheet to fix the toner image on the sheet, while feeding the sheet. 5 In FIG. 2, when the belt 13 offsets toward a right-hand side in the Figure during operation of the fixing device 114, the lateral edge 13*b* of the belt 13 enters the detection region of the photo-sensor 59. Then, the photo-sensor 59 having been producing an OFF signal detects the lateral edge of the photo-sensor to produce an ON signal and supplies the produced signal to the controller 117. The controller 117 controls the rotation of the stepping motor 50 to rotate the steering roller supporting arm 54*b* provided with the sector gear 52 about the shaft 55*b* upwardly in the Figure. By this, one end of the steering roller 15 rises, and the other end, as shown in FIG. 8, does not change its position since the steering roller supporting arm 54*a* is fixed on the outside of the side plate 20*a*.

Therefore, the right-hand side of the steering roller 15 rises in FIGS. 2, 3, 4, and therefore, the steering roller 15 inclines. As a result, the belt 13 is slightly twisted to shift in the opposite direction, that is, toward the left side in FIGS. 2, 3, 4.

When the steering roller 15 is inclined so that right-hand side rises in FIG. 2, 3, 4, the oil application roller 16 connected with the belt arm member 17*b* is also inclined substantially similarly to the steering roller 15. Although the belt 13 is slightly twisted, the oil application roller 16 can incline following the twisting of the belt 13 against the spring forces the urging springs 19*a*, 19*b*, since the oil application roller 16 is rotatably connected with the steering roller 15 by the belt arm members 17*a*, 17*b*.

In this manner, even if the belt is twisted by the steering roller 15, the oil application roller 16 follows the twisting, and therefore, the oil application roller 16 keeps that close-contact to the inner surface 13*a* of the belt 13. Therefore, even if the steering roller moves, the oil application roller 16 is able to properly apply the silicon oil (lubricant) to the inner surface of the belt.

Thereafter, when the lateral edge of the belt 13 leaves the detection region of the photo-sensor 59, the photo-sensor 59 supplies the OFF the signal to the controller 117.

The controller 117 controls the rotation of the stepping motor 50 to rotate the steering roller supporting arm 54*b* about the shaft 55*b* downwardly in the Figure through the warm 51 and the sector gear 52. Then, said one end of the steering roller 15 lowers, but the other end, as shown in FIG. 8, does not change its position since the steering roller supporting arm 54*a* is fixed on the outside of the side plate 20*a*.

Therefore, the steering roller 15 inclines such that right-hand side of the steering roller 15 lowers in FIGS. 2, 3, 4. As a result, the belt 13 is slightly twisted to shift in the opposite direction, that is, toward the right-hand side in FIG. 2, 3, 4.

When the steering roller 15 inclines such that right-hand side lowers in FIG. 2, 3, 4, the oil application roller 16 which is connected with the belt arm members 17*a*, 17*b* inclines substantially similarly to the steering roller 15. Although the belt 13 is slightly twisted, the oil application roller 16 follows the twisting of the belt 13 against the spring forces of the urging springs 19*a*, 19*b*, since the oil application roller 16 is rotatably connected with the steering roller 15 by the belt arm members 17*a*, 17*b*. Therefore, in this case, too, the oil application roller 16 follows the twisting of the belt 13 to keep the close-contact to the inner surface 13*a* of the belt 13, so that silicon oil can be properly applied to the inside surface of the belt 13.

By the repetition of the controlling operation, the belt 13 continues slightly snaking travel in the longitudinal direction, so that lateral offset of the belt 13 can be prevented in the circulation movement of the belt.

With the above-described the structure, there is a liability that parallelism between the steering roller 15 and the oil application roller 16 is disturbed by the displacement of one of the ends (rear side end in FIG. 1) of the steering roller 15 in the direction indicated by an arrow B by the belt steering (position correction). However, the oil application roller 16 follows the position displacement of the inner surface of the belt 13 to contact always stably therewith.

In addition, there is a possibility that a distance between the shafts of the steering roller 15 and the oil application roller 16 in addition to the parallelism therebetween may vary because of the variation in the circumferential lengths resulting from the manufacturing tolerances at the opposite lateral ends of the belt 13, the variation in the urging forces of the tension springs 56*a* 56*b*, and other variations in the parts. In such cases, the oil application roller 16 follows the position displacement of the inner surface 13*a* of the belt 13, and therefore, it can be kept contacted to the inner surface 13*a* of the belt 13 stably.

Therefore, the oil application function of the oil application roller 16 is stabilized, and as a result, the frictional resistance between the inner surface 13*a* of the belt 13 and the pressing pad 18 is reduced, and then stabilization in the travelling of the belt 13 can be maintained for a long-term.

In such a manner, with the fixing device of the first embodiment, the sheet can be stably fed by the belt, and the toner image can be fixing on the sheet stably, for long-term.

Embodiment 2

The second embodiment of the present invention will be described. Since the image forming apparatus of this embodiment is similar to the first embodiment, the same reference numerals as in Embodiment 1 are assigned to the elements having the corresponding functions in this embodiment, and the detailed description thereof is omitted for simplicity.

(Structure of Fixing Device)

Referring to FIG. 10 through FIG. 15, the fixing device (image heating apparatus) will be described. The structures around the belt 13 of this embodiment are similar to those of the fixing device 114 of Embodiment 1, and therefore, the same reference numerals are assigned to the elements having the corresponding functions.

The fixing device 115 comprises an induction heating coil 35, a belt feeding device 122 and a belt feeding device 121 which has similar structures to the belt feeding device 121 employed in the Embodiment 1.

The belt feeding device 122 comprises a heating belt 30 in the form of an endless belt, a driving roller 31 and a steering roller 32 functioning as a supporting member (displacement member). Furthermore, the belt feeding device 122 comprises a cleaning roller 33 functioning as a cleaning member, an arm members 34*a*, 34*b* (FIG. 12 to FIG. 14) functioning as displacement means (holding member), a pad stay 37, an urging springs 36*a*, 19*b*, a correction mechanism 118.

The heating belt 30 is circulatably trained, with a predetermined tension (196N), for example, around the driving roller 31 (supporting member), and the steering roller 32 (supporting member) having a belt steering function and belt tension applying function.

Figure 11:
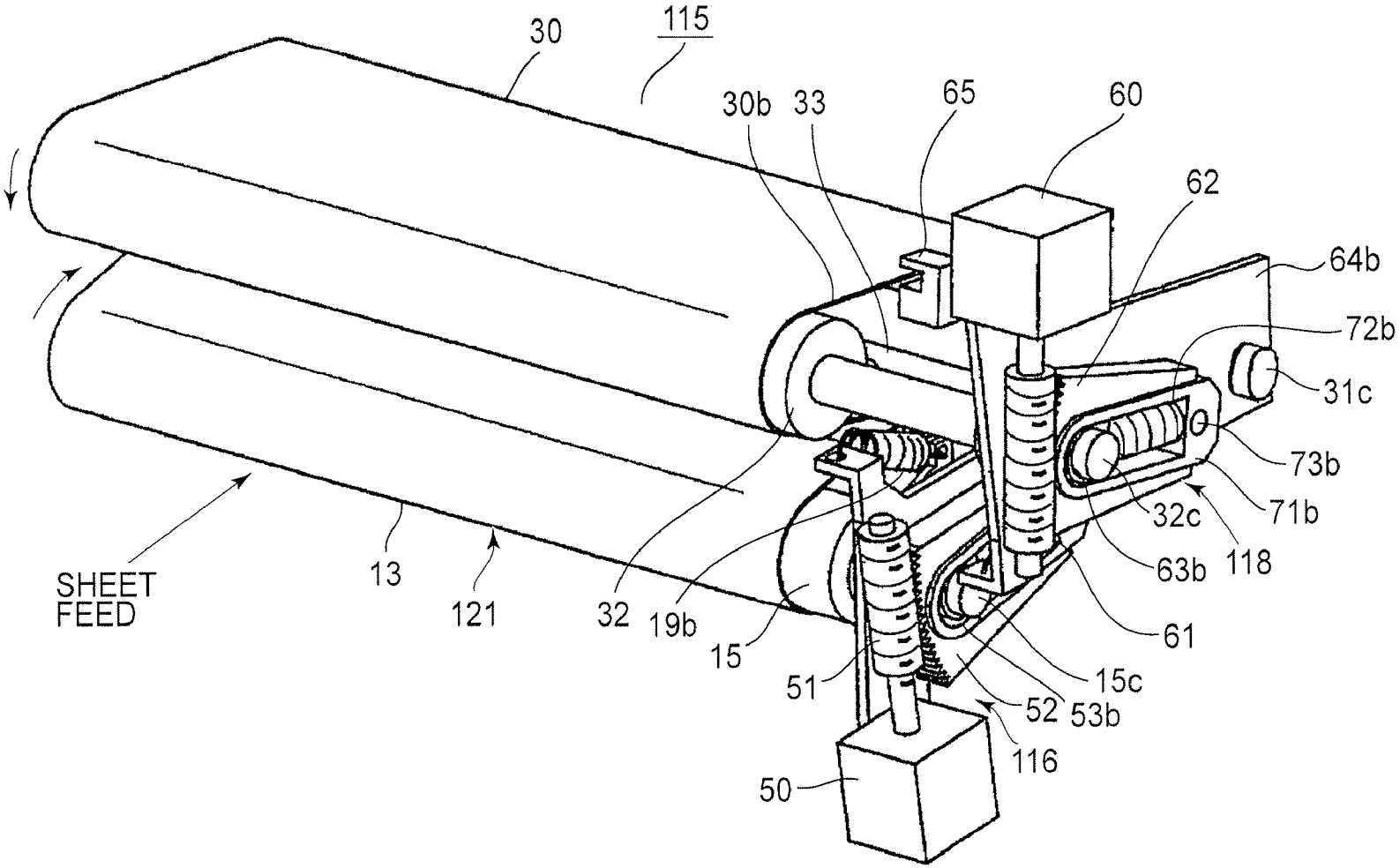
FIG. 11 is a perspective view of an outer appearance of a belt feeding device employed in the fixing device of FIG. 10.
Figure 15:
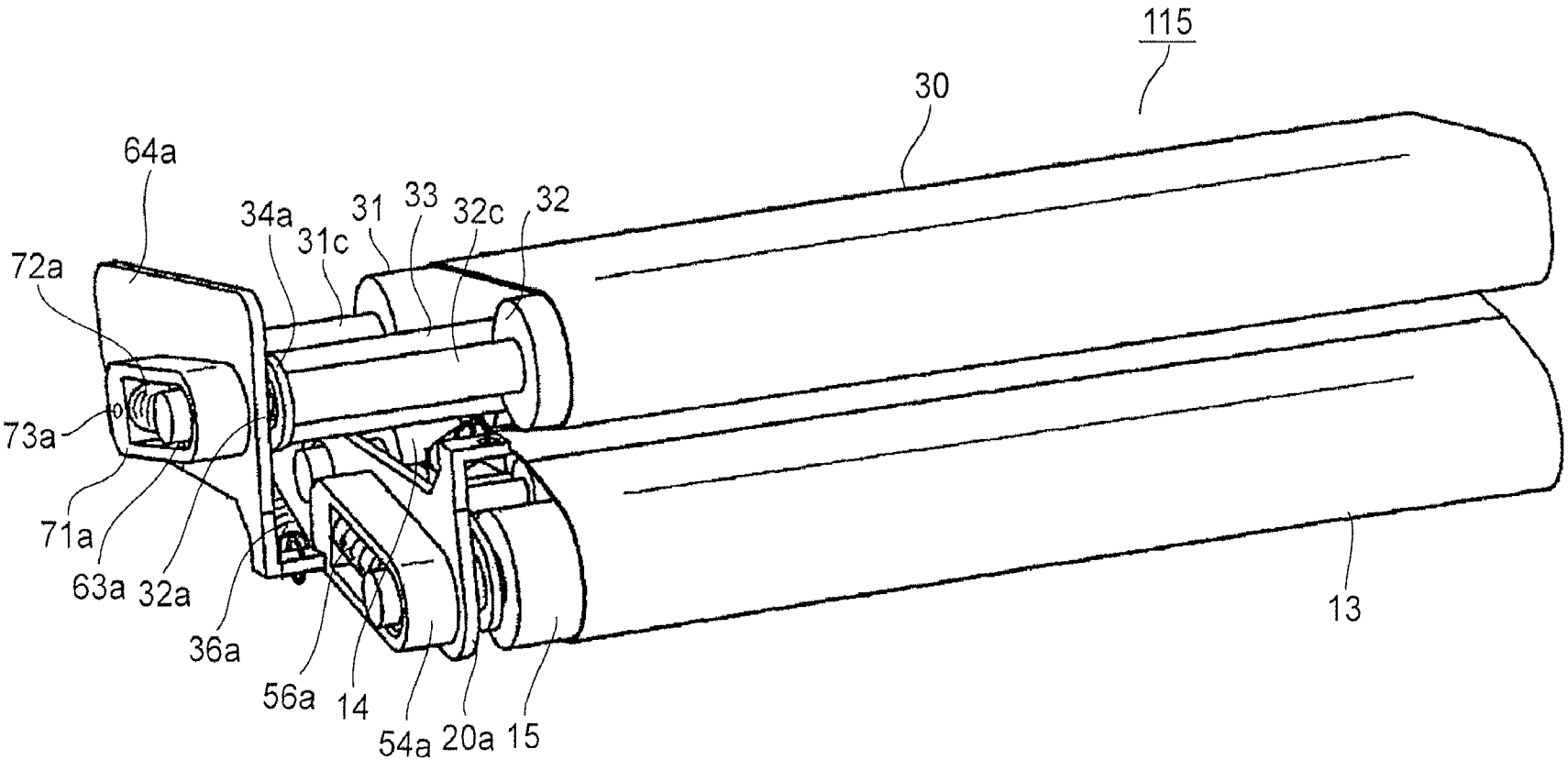
FIG. 15 is a perspective view of an outer appearance of a belt feeding device employed in the fixing device of FIG. 10.

The driving roller 31 includes a solid stainless steel core metal having an outer diameter of 18 mm, and an elastic surface layer of heat resistive silicone rubber integrally formed with the core metal. The driving roller 31 is disposed at the entrance side of the nip region formed by the heating belt 30 and the belt 13. The heat resistive silicone rubber elastic layer of the driving roller 31 is elastically deformed by a predetermined degree by the pressure of the pressing roller 14. The shaft 31*c* of the driving roller 31 is supported on the side plates 64*a*, 64*b* as shown in FIGS. 11 and 15.

The steering roller 32 is a hollow roller of stainless steel having an outer diameter of 20 mm and an inner diameter of 18 mm, and functions as a steering roller for adjusting snaking movement in the widthwise direction perpendicular to the moving direction of the heating belt 30 and also functions as a belt stretching roller.

The heating belt 30 may be any belt if it is able to produce heat by the induction heating coil 35 and it has sufficient heat resistivity. The heating belt 30 comprises a magnetic metal layer such as a nickel metal layer, a stainless steel layer or the like which has a thickness of 75 &m&m, a width of 380 mm and a circumferential length of 200 mm, and a coating of silicone rubber thereon which has a thickness of 300 &m&m, for example.

Such a portion of the inside of the heating belt 30 as corresponds to the entrance side (the upstream side of the driving roller 31) of the nip region formed between the heating belt 30 and the belt 13, is provided with a pad stay 37 of stainless steel (SUS material), for example. The pad stay 37 is pressed to the pressing pad 18 with a predetermined pressure (400N, for example) to form a nip with the driving roller 31.

Between the steering roller 32 and the pad stay 37, a cleaning roller 33 (cleaning member) is provided to clean the inner surface of the heating belt 30. The cleaning roller 33 is connected with the steering roller 32 by arm members 34*a*, 34*b* (supporting member, FIGS. 13 and 14). The arm members 34*a*, 34*b* is rotatably supported on bearings 32*a*, 32*b* provided on the steering roller 32. Ends of the arm members 34*a*, 34*b* are provided with bearings 33*a*, 33*b* for the cleaning roller 33. Both ends of the shaft 33*c* of the cleaning roller 33 (FIGS. 4 and 7) are supported on the bearings 33*a*, 33*b*. Therefore, the opposite ends of the cleaning roller 33 are rotatably (relative to the arm members 34*a*, 34*b*) supported by the bearings 33*a*, 33*b*. The cleaning roller 33 comprises a core metal of stainless steel and a surface layer of heat resistive aramid felt fixed by boding thereon.

Figure 12:
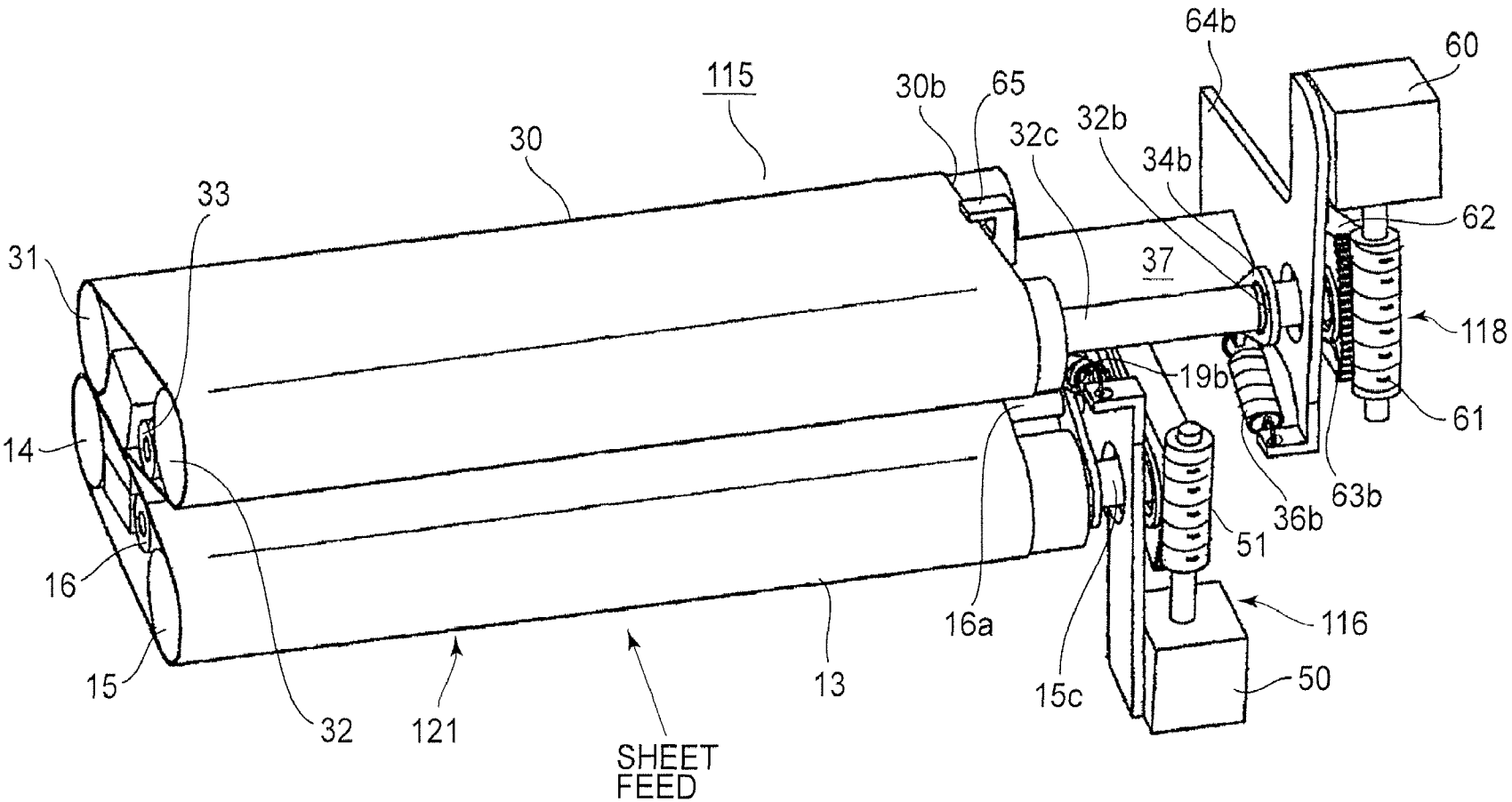
FIG. 12 is a perspective view of an outer appearance of a belt feeding device employed in the fixing device of FIG. 10.
Figure 13:
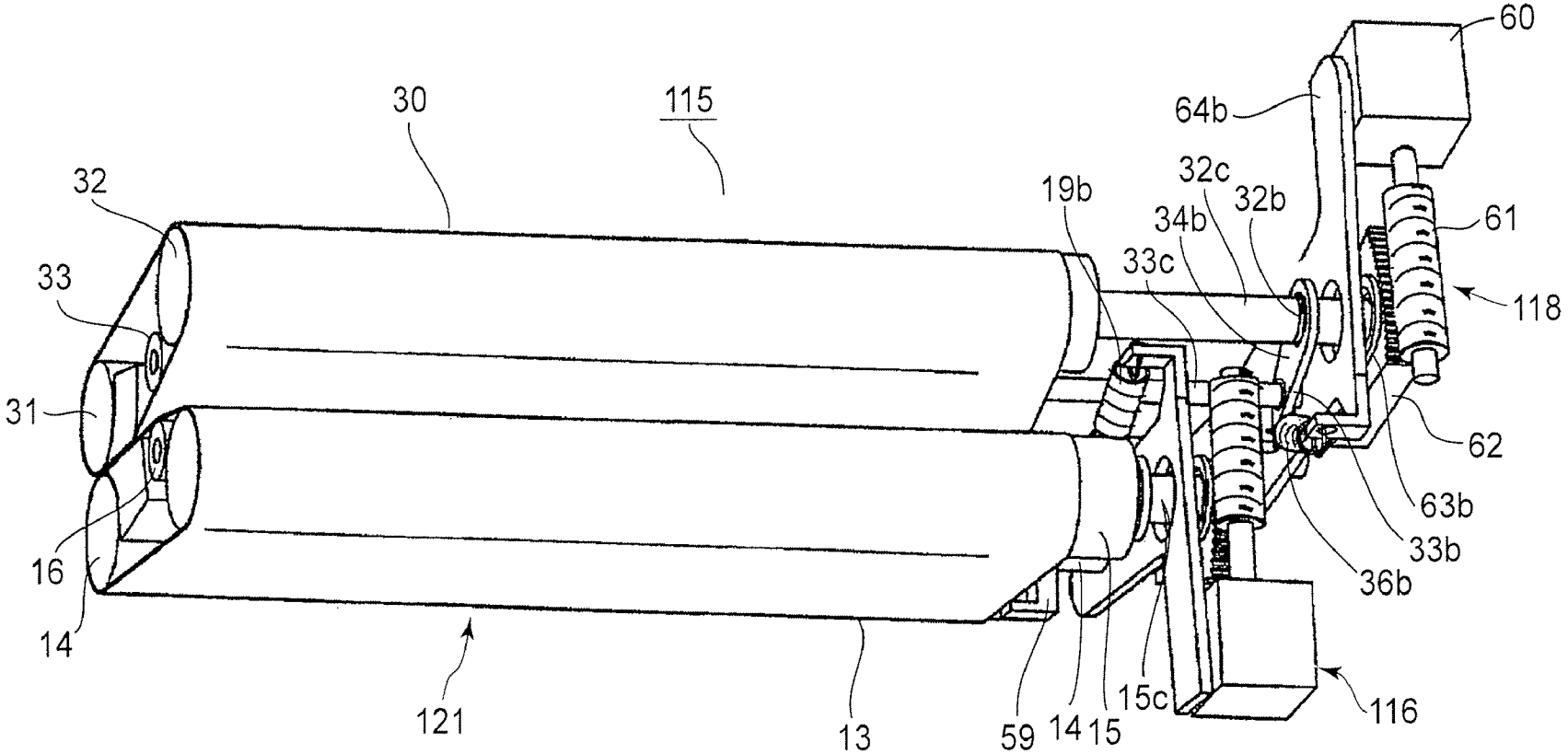
FIG. 13 is a perspective view of an outer appearance of a belt feeding device employed in the fixing device of FIG. 10.
Figure 14:
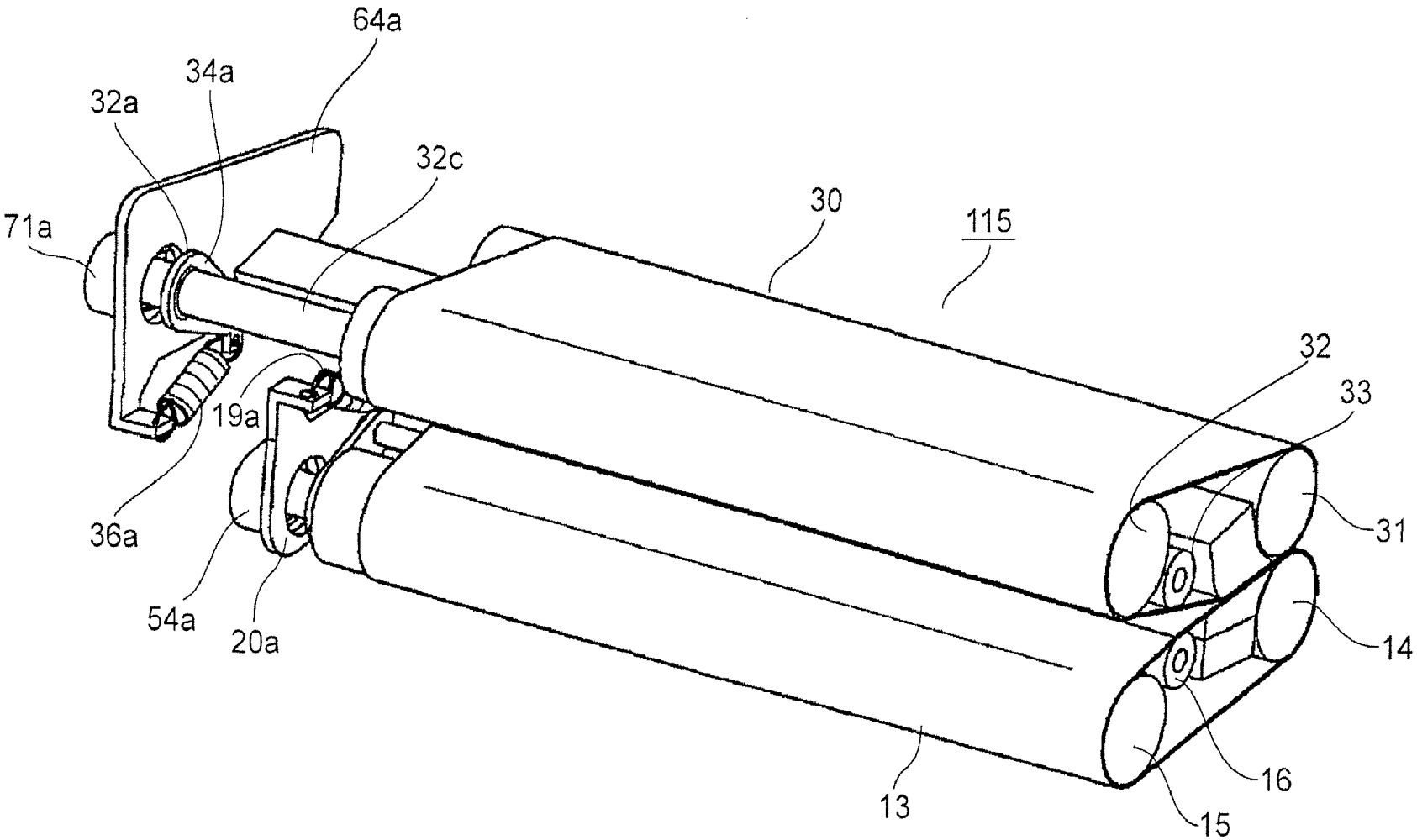
FIG. 14 is a perspective view of an outer appearance of a belt feeding device employed in the fixing device of FIG. 10.

The arm urging springs 36*a*, 36*b* (FIGS. 12-14) are stretched around and between the arm members 34*a*, 34*b* S and the side plates 64*a*, 64*b* (FIGS. 12-14). The arm urging springs 36*a*, 36*b* functions to closely contact the cleaning roller 33 to the heating belt 30 so that cleaning roller 33 can be assured to remove the foreign matter deposited on the inner surface 30*a* of the heating belt 30 and so that heating belt 30 is tensioned.

As shown in FIGS. 11 and 15, a shaft 73*b* is projected outwardly from the side plate 64*b*, and on the shaft 73*b* a steering roller supporting arm 71*b* is rotatably supported to support the steering roller 32. The outer periphery of the steering roller supporting arm 71*b* is provided with a sector-shape gear 62. The sector gear 62 is in meshing engagement with a warm 61 which is rotatable by a stepping motor 60. Therefore, the steering roller supporting arm 71*b* is rotatable about the shaft 73*b* by the stepping motor 60.

As shown in FIG. 15, a shaft 73*a* is projected from a side plate 64*b*, and a steering roller supporting arm 71*b* for supporting the steering roller 32 is fixed on the shaft 73*a* at the outside of the side plate 64*a*.

In FIG. 11, the steering roller supporting arm 71*b*, the sector gear 62, the warm 61, the stepping motor 60 and so on constitute a correction mechanism 118 (swing means) for correcting the circulation position of the belt by inclining the steering roller 32 relative to the driving roller 31.

As shown in FIGS. 11*s* and 15, the steering roller supporting arms 71*a*, 71*b* support the steering roller bearings 63*a*, 63*b*. The steering roller bearings 63*a*, 63*b* rotatably supports the shaft 32*c* of the steering roller 32 so that steering roller supporting arms 71*a*, 71*b* are supported slidably in the direction of the belt tension. In addition, the steering roller supporting arms 71*a*, 71*b* also support the tension springs 72*a*, 72*b* for urging the steering roller bearings 63*a*, 63*b* in the belt tension direction.

As shown in FIG. 11, a photo-sensor 65 for detecting the lateral edge 30*b* of the heating belt 30 is provided adjacent to the lateral edge 30*b* of the heating belt 30.

(Various Operations of Fixing Device)

When the sheet P having the transferred toner image T thereon is fed into the fixing device 115, the sheet is fed by the nip provided by the circulating belts 13, 30. At this time, the belts 13, 30 are nipped between the pad stay 37 and the pad 18 and between the driving roller 31 and the pressing roller 14, and therefore, they nip the sheet. The heating belt 30 is heated by the induction heating coil 35. Therefore, the fixing device 115 applies heat and pressure to the sheet to fix the toner image on the sheet, while feeding the sheet.

In FIG. 11, when the heating belt 30 offsets toward the right-hand side in the Figure during operation of the fixing device 115, the lateral edge 30*b* of the heating belt 30 enters a detection region of the photo-sensor 65. Then, the photo-sensor 65 having been in the OFF state now detects the lateral edge of the heating belt 30 to produce the ON signal and feeds it to the controller 117. The controller 117 controls the rotation of the stepping motor 60 to rotate the steering roller supporting arm 71*b* provided with the sector gear 62 about the shaft 73*b* upwardly in the Figure. By this, one end of the steering roller 32 rises, and the other end, as shown in FIG. 15, does not change its position since the steering roller supporting arm 71*a* is fixed on the outside of the side plate 64*a*.

Therefore, the right-hand side of the steering roller 32 rises in FIGS. 11, 12 and 13, and therefore, the steering roller 32 inclines. As a result, the heating belt 30 is slightly twisted, and shifts in the opposite direction, that is, toward left side in FIGS. 11, 12, 13.

When the right-hand side of the steering roller 32 rises to incline, the cleaning roller 33 connected with the belt arm member 34*b* also inclines substantially similarly to the steering roller 32. The heating belt 30 is slightly twisted, but the cleaning roller 33 is capable of inclining following the twisting of the heating belt 30 against the spring forces of the urging springs 36*a*, 36*b* since the cleaning roller 33 is rotatably connected with the steering roller 32 by the belt arm members 34*a*, 34*b*.

Thus, even when the belt is twisted due to displacement of the steering roller 32, the cleaning roller 33 follows it, and therefore, the cleaning roller 33 keeps the close-contact to the inner surface 30*a* of the heating belt 30. For this reason, even when the displacement of the steering roller occurs, the cleaning roller 33 is capable of properly removing the inner surface of the belt.

When the lateral edge of the heating belt 30 exits the detection region of the photo-sensor 65, the photo-sensor 65 feeds the OFF signal to the controller 117.

The controller 117 controls the rotation of the stepping motor 60 to rotate the steering roller supporting arm 71*b* about the shaft 73*b* downwardly in the Figure through the warm 61 and the sector gear 62. Then, said one end of the steering roller 32 lowers, but the other end, as shown in FIG. 15, does not change its position since the steering roller supporting arm 71*a* is fixed on the outside of the side plate 64*a*.

Therefore, the steering roller 32 inclines such that right-hand side of the steering roller 32 lowers in FIG. 11, 12, 13. As a result, the heating belt 30 is slightly twisted and is laterally shifted in the opposite direction, that is, toward the right-hand side in FIGS. 11, 12, 13.

When the right-hand side of the steering roller 32 lowers in FIGS. 11, 12, 13 so that steering roller 32 inclines, the cleaning roller 33 connected with the belt arm members 34*a*, 34*b* also inclines similarly to the steering roller 32. The heating belt 30 is slightly twisted, but the cleaning roller 33 inclines with the twisting of the heating belt 30 against the spring forces the urging springs 36*a*, 36*b*, since the cleaning roller 33 is rotatably connected with the steering roller 32 by the belt arm members 34*a*, 34*b*. Therefore, in such a case, following the twisting of the heating belt 30, the cleaning roller 33 is kept close-contacting to the inner surface 30*a* of the heating belt 30, so that foreign matter deposited on the inner surface of the belt can be removed assuredly.

By repeating the controlling operation, the heating belt 30 continues snaking movement in the longitudinal direction so that circulation, with lateral shifting, of the heating belt 30 is prevented.

With the above-described structure, there is a liability that the parallelism between the cleaning roller 33 and the steering roller 32 deteriorates, when one side end of the steering roller 32 (the rear side end in FIG. 10) is displaced in the direction of an arrow B for the purpose of the belt steering operation (position correction). However, the cleaning roller 33 is always and stably kept contacting with the inner surface of the heating belt 30 following the position change of the heating belt 30.

A distance between the axes of the steering roller 32 and the cleaning roller 33 as well as the parallelism therebetween may vary due to the accuracy error in the circumferential length of the heating belt 30, variation in the urging forces of the tension springs 72*a*, 72*b* and/or other errors of parts. Even in such a case, the cleaning roller 33 follows the position change of the inner surface 30*a* of the heating belt 30, and therefore, the cleaning roller 33 is kept always and stably contacting with the inner surface 30*a*.

Therefore, the cleaning function of the cleaning roller 33 is stabilized, and as a result, the frictional resistance between the pad stay 37 and the inner surface 30*a* of the heating belt 30 is reduced, so that travelling of the heating belt 30 can be stabilized for a long term.

Thus, the fixing device of this example can feed the sheet by the belt travelling stably for a long term, and can fix the toner image on the sheet, and therefore, can properly fix the toner image.

The belt arm members 17*a*, 17*b*, 34*a*, 34*b* are connected rotatably with the steering rollers 15, 32, but it may be rotatably mounted on an unshown fixing member. Belt arm members 17*a*, 17*b*, 34*a*, 34*b* are preferably mounted on the steering rollers 15, 32, since then, the oil application roller 16 and the cleaning roller 33 are assuredly inclined following the inclination of the steering rollers 15, 32 to follow the twisting of the belts 13, 30.

Not all of the members for supporting the travelling belt may be rollers. For example, the steering roller may be a non-rotatable fixed member which is slidable relative to the belt.

Figure 1:
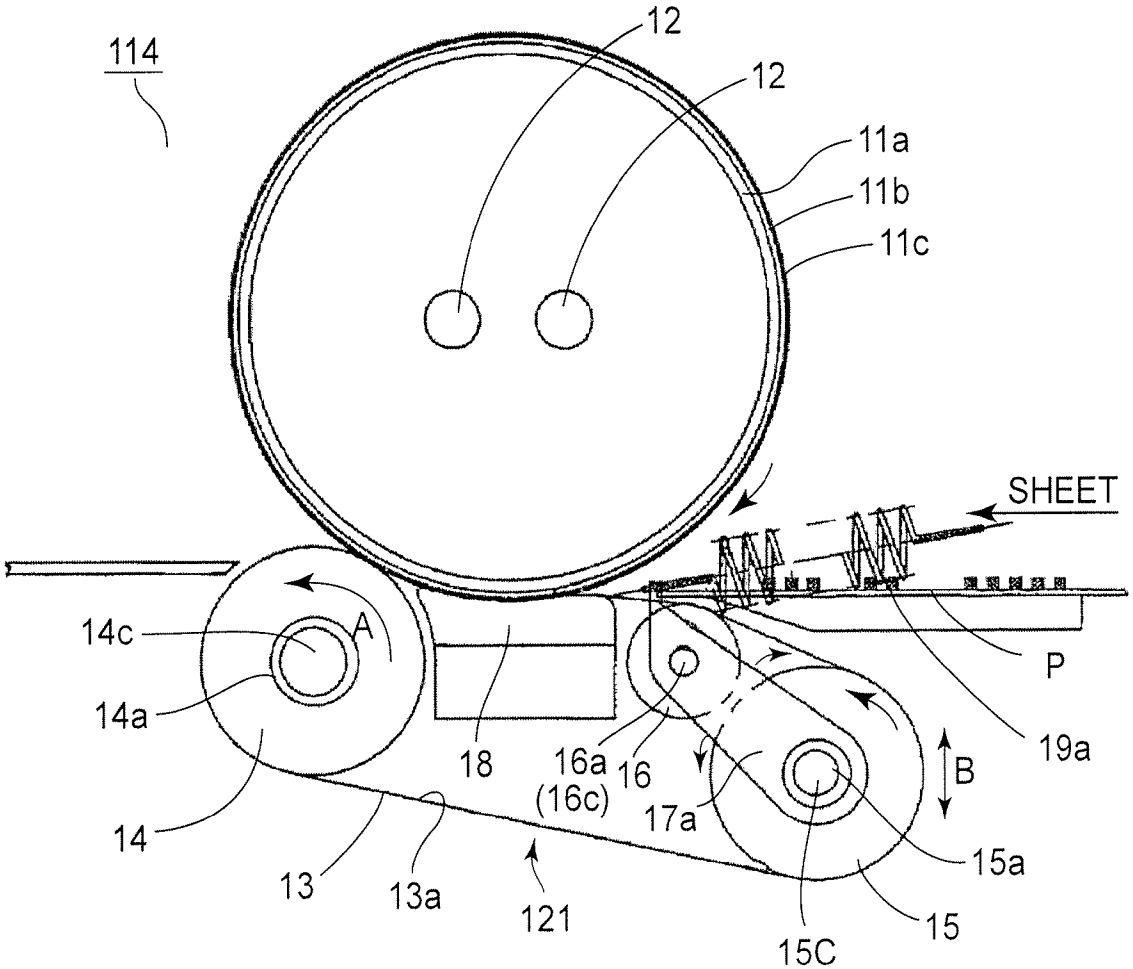
FIG. 1 is a schematic view of a fixing device (image heating apparatus) and a belt feeding device according to a first embodiment of the present invention.
Figure 10:
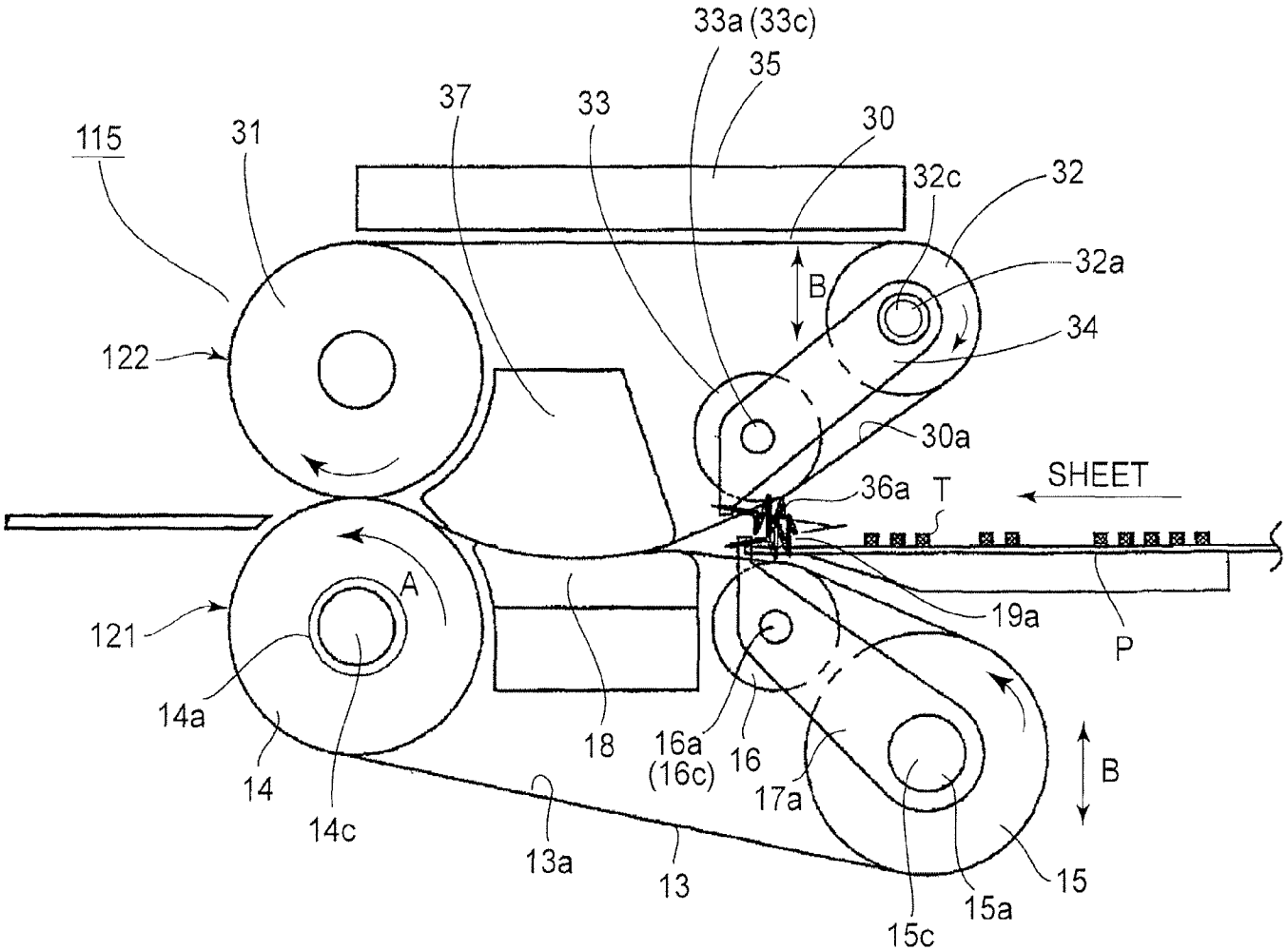
FIG. 10 is a schematic view of fixing device and a belt-feeding device according to a second embodiment of the present invention.

In FIGS. 1, 10, the rear sides of the steering rollers 15, 32 vertically move for the inclination, but the front sides may be vertically movable for the inclination.

In the foregoing embodiment, the image heating apparatus is a fixing device, but this is not limiting to the present invention. For example, it may be a glossiness improving apparatus for improving a glossiness of the image by re-heating the toner image fixed on the sheet.

Figure 16:
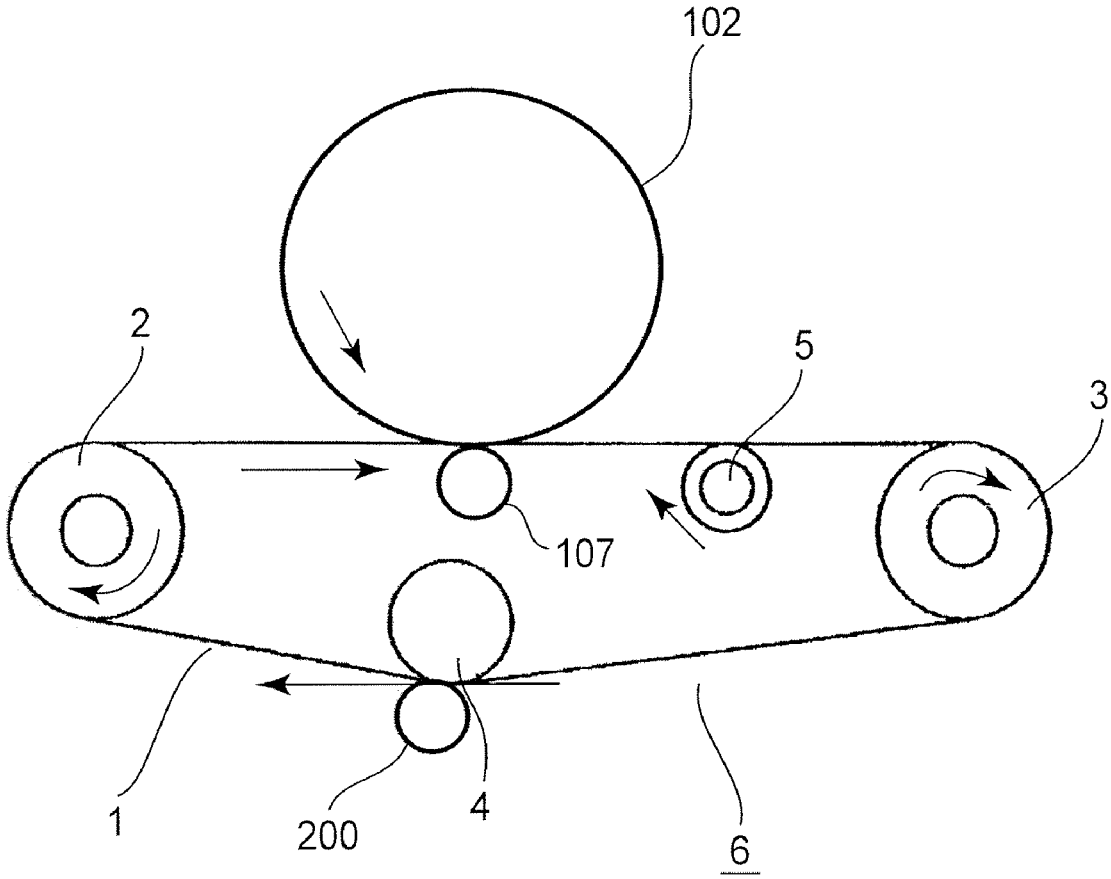
FIG. 16 is a schematic view of a belt feeding device.

Furthermore, in the foregoing embodiments, the stabilization of the travelling of the endless belt provided in the image heating apparatus is intended, but the present invention is similarly applicable to a belt feeding device as shown in FIG. 16.

More particularly, the cleaning roller 5 as a cleaning member for cleaning the inner surface of the intermediary transfer belt (image receiving belt) 1 may be supported by a common supporting member similarly to the foregoing embodiment. By doing so, the cleaning roller 5 is displaced in accordance with displacement of the steering roller 3, and therefore, even if the belt is displaced by the steering roller, the inner surface of the belt can be properly cleaned by the cleaning roller. Designated by reference numeral 3 is a driving roller; 4 is a tension roller; 102 is a photosensitive drum (similar to Embodiment 1); 107 is a primary transfer roller (similar to Embodiment 1); and 200 is a secondary transfer roller.

The present invention is not limited to the case of an intermediary transfer belt as the endless belt, but it is usable with an endless belt type photosensitive member. In such a case, a cleaning roller is provided to the inner surface of the photosensitive belt, and a cleaning roller and a steering roller supporting the photosensitive belt are supported by a common holding member.

In the above-described structure of the mechanism for displacing the oil application roller and/or the cleaning roller in accordance with displacement of the steering roller, they are supported by a common supporting member, but the present invention is not limited to such an example. For example, a displacing mechanism for displacing the oil application roller and/or the cleaning roller is separately provided, in addition to a displacing mechanism for displacing the steering roller. Namely, these displacing mechanisms are interrelated with each other such that oil application roller and/or the cleaning roller is displaced in interrelation with the displacement of the steering roller.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 266116/2005 filed Sep. 13, 2005 which is hereby incorporated by reference.

What is claimed is:

1. An image heating apparatus, composing:

an endless belt for heating an image on a recording material at a nip;

a pressing pad for pressing said belt at said nip;

a belt supporting member for supporting said belt at an inner surface thereof, said belt supporting member being displaceable to move said belt in a widthwise direction of said belt;

a lubricant application member for applying lubricant onto the inner surface of said belt; and displacing means for displacing said lubricant application member in accordance with a displacement of said belt supporting member.

2. An apparatus according to claim 1, wherein said displacing means has a lubricant application member supporting member for supporting said lubricant application member.

3. An apparatus according to claim 2, wherein said lubricant application member supporting member supports said belt supporting member and a rotation shaft of said lubricant application member.

4. An apparatus according to claim 1, wherein said lubricant application member is disposed in a region which said belt is capable of entering with the displacement of said belt supporting member.

5. An image heating apparatus, comprising:

an endless belt for heating an image on a recording material at a nip;

a belt supporting member for supporting said belt at an inner surface thereof, said belt supporting member being displaceable to move said belt in a widthwise direction of said belt;

a cleaning member for cleaning the inner surface of said belt;

displacing means for displacing said cleaning member in accordance with a displacement of said belt supporting member.

6. An apparatus according to claim 5, wherein said displacing means has a cleaning member supporting member for supporting said belt supporting member and said cleaning member.

7. An apparatus according to claim 6, wherein said cleaning member supporting member supports said belt supporting member and a rotation shaft of said cleaning member.

8. An apparatus according to claim 5, wherein said cleaning member is disposed in a region which said belt is capable of enter with the displacement of said belt supporting member.

* * * * *